United States Patent [19]

Beacham

[11] Patent Number: 5,030,151

[45] Date of Patent: Jul. 9, 1991

[54] FLANGED FIN FOR WATERCRAFT

[76] Inventor: Christopher J. Beacham, 51 Old Barrenjoey Road, Avalon Beach. N.S.W. 2000, Australia

[21] Appl. No.: 439,038

[22] PCT Filed: Apr. 13, 1987

[86] PCT No.: PCT/AU87/00100

§ 371 Date: Nov. 16, 1989

§ 102(e) Date: Nov. 16, 1989

[87] PCT Pub. No.: WO88/07883

PCT Pub. Date: Oct. 20, 1988

[51] Int. Cl.[5] ..... B63B 35/79

[52] U.S. Cl. ..... 441/79; 114/127; 114/140

[58] Field of Search ..... 441/79; 114/127, 135, 114/136, 137, 140, 142, 126, 274, 280, 152; 440/51, 82

[56] References Cited

U.S. PATENT DOCUMENTS

| | | | |
|---|---|---|---|
| 2,931,332 | 4/1960 | Hebrank | 114/274 |
| 2,972,974 | 2/1961 | Follett | 114/280 |
| 3,087,452 | 4/1963 | Grimston | 114/280 |
| 3,089,157 | 5/1963 | May | 9/310 |
| 3,516,099 | 6/1970 | Morey et al. | 114/126 |
| 3,747,138 | 7/1973 | Morgan | 441/79 |
| 3,965,514 | 6/1976 | Shafer | 9/310 |
| 4,320,546 | 3/1982 | Knox | 441/79 |

FOREIGN PATENT DOCUMENTS

| | | |
|---|---|---|
| 539918 | 2/1982 | Australia . |
| 3448184 | 4/1985 | Australia . |
| 56-25090 | 3/1981 | Japan . |
| 463774 | 4/1937 | United Kingdom . |

*Primary Examiner*—Sherman Basinger
*Assistant Examiner*—Thomas J. Brahan
*Attorney, Agent, or Firm*—Lahive & Cockfield

[57] ABSTRACT

The invention relates to fins for watercraft such as surfboards, surf-skis, sailboards, kayaks, canoes, skiffs, water-skis, and also "soft" plastic watercraft such as polyethylene boards. These fins have an apertured, basal flange; each fin being affixable, in a variety of positions, to the underside of the watercraft via fixing means extending through the apertures in the flange and into the fabric of the watercraft.

4 Claims, 7 Drawing Sheets

Fig 7.
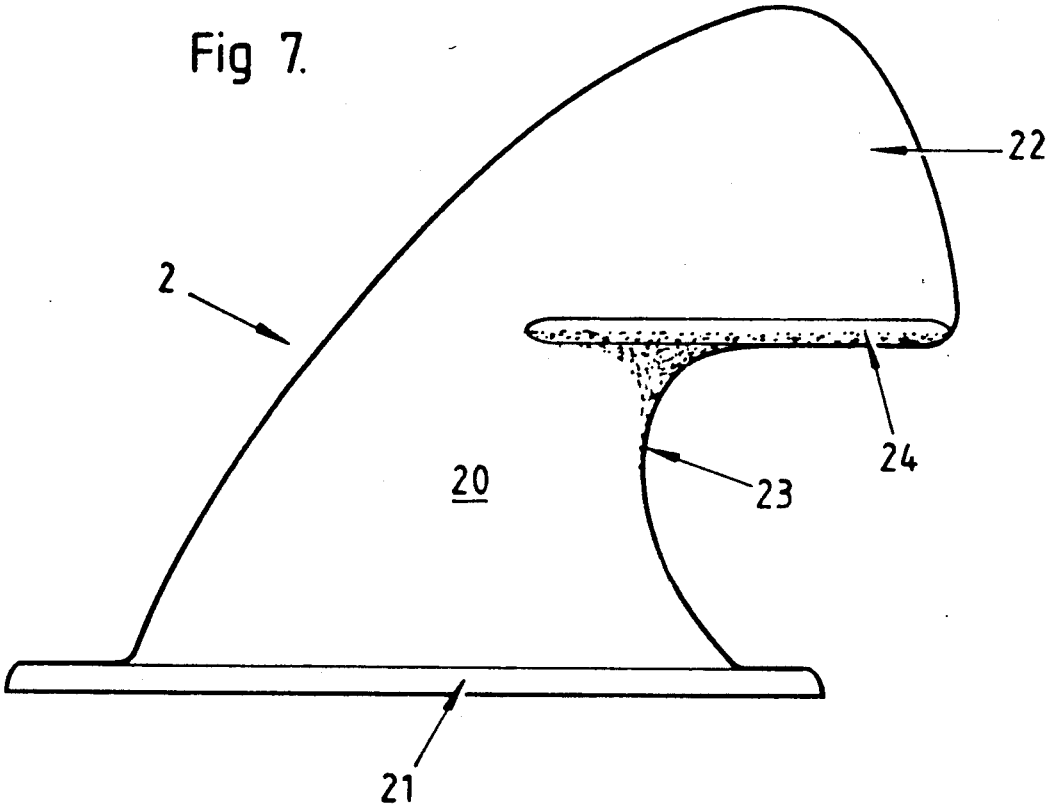
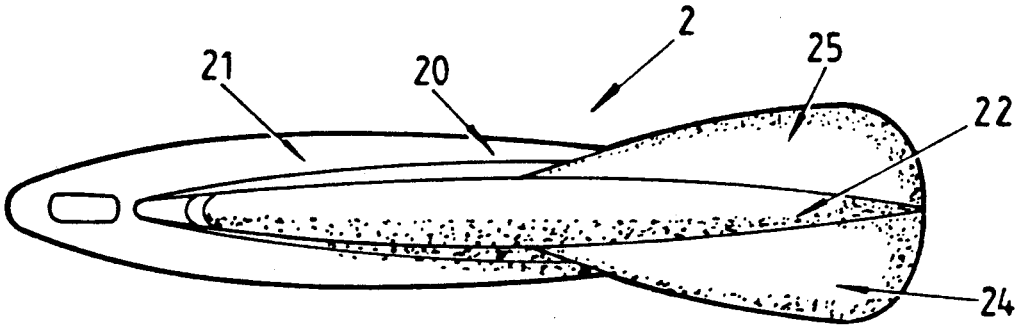
Fig 8.

Fig 15.
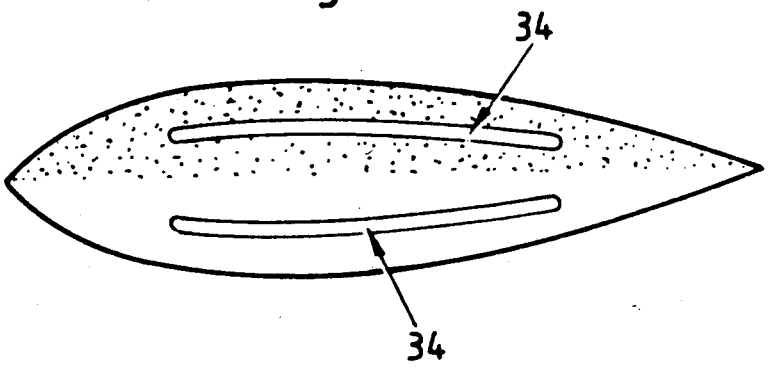
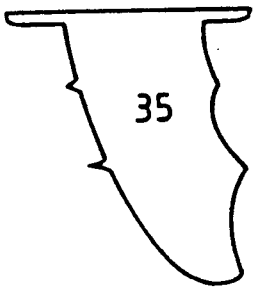
Fig. 16
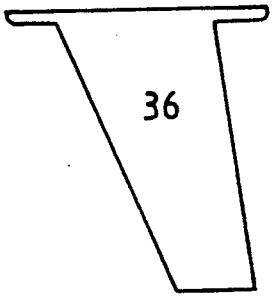
Fig. 17
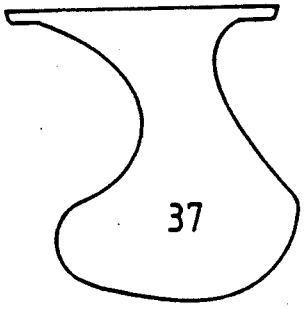
Fig. 18
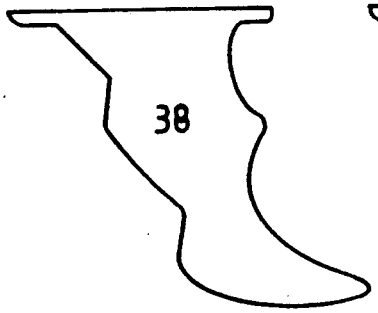
Fig. 19
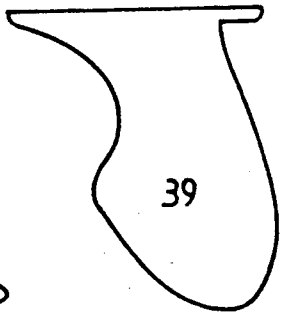
Fig. 20
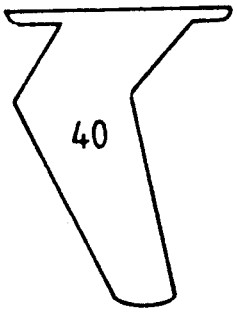
Fig. 21

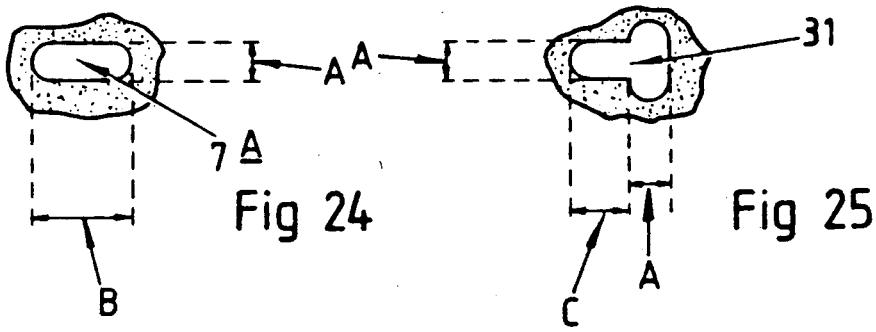
Fig 24
Fig 25
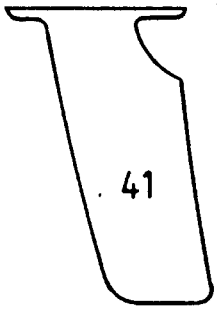
Fig. 22
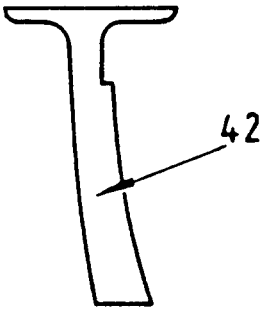
Fig. 23
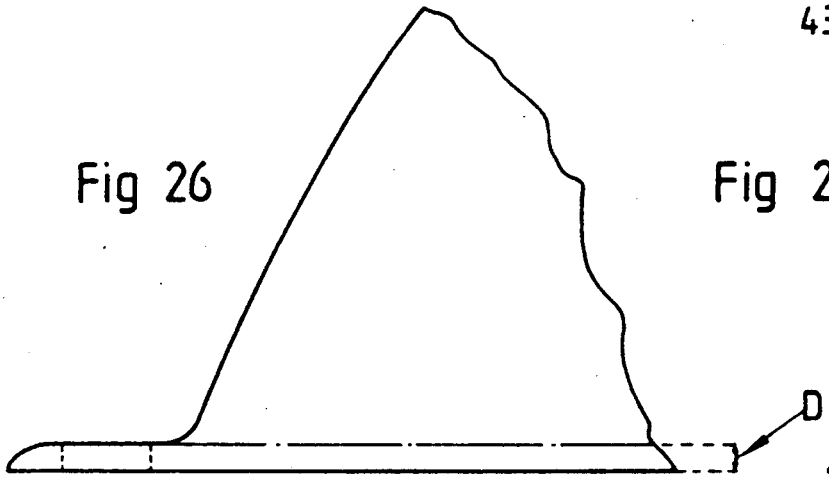
Fig 26
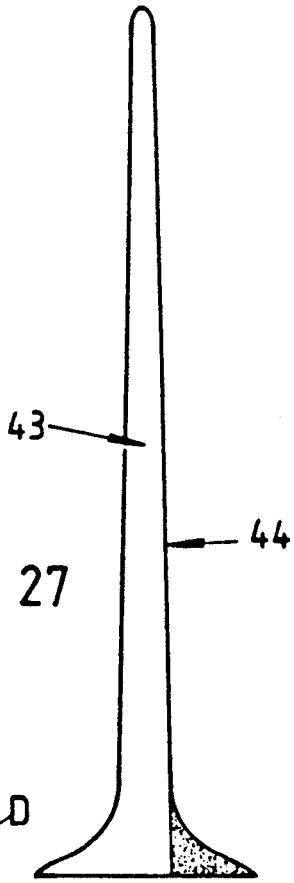
Fig 27

FLANGED FIN FOR WATERCRAFT

TECHNICAL FIELD

This invention relates to finned watercraft, such as surfboards and the like, of the kind having a stabilizing fin or fins, and especially to fins suitable therefor.

BACKGROUND ART

The sport of riding a board on the crest of a wave as it approaches the shore is old. European seafarers of the 18th century reported having seen this feat performed in the "Sandwich Islands".

In course of time, knowledge of this new, exciting sport spread from Hawaii to California, from whence it was introduced into such other countries as Australia, South Africa and so forth.

The traditional surfboards were heavy, curvilinear wooden artifacts, from 12 to 20 feet in length, and only the strongest surfers could readily handle them.

Subsequently, more modern surfboards began to be made from plastic, polyurethane foam, and fiberglass, with the fin set into what is termed a "fin-box" let into the underside or fixed insitu with fiberglass. While a fin-box admittedly provides a fin, set therein, with good resistance to laterally-applied force, the original object of the insert fin-box was apparently to allow for ease of transport, inasmuch as boards with the fins removed could be safely stacked one on top of the other. Damage of fins in transit was a major problem.

With a single fin, even moderately difficult conditions are enough to cause the "spin-out" which is so frustrating and even dangerous to the rider; this phenomenon to be caused by insufficient lateral adhesion between fin and water, and so attempts were made to counteract it by increasing the depth and lateral area of the base of the fin. The result was excessive drag and loss of maneuverability owing to the "keel effect" of the enlarged fin, which led to even poorer performance.

Variations of the finned board have been tried out (boardriders being notoriously prone to experiment) for example, laterally-spaced paired fins (the so-called "twin-fin board"). This produced a surfboard which was slightly more maneuverable and capable of "tighter" turns under ideal conditions but which tended to "spin-out" in big waves. It should here be noted that what in a conventional marine hull is called the chine is, in surfing parlance, termed the "rail". When a turn is made on a surfboard it is canted sideways and this action, with the keel effect of the fin keying in to the moving water, allows the turns to be made. A board having laterally paired fins will, when canted hard enough onto one of its rails, permit a quite tight turn, but is physically more difficult to cant over because the water funnels between the two fins and tends to keep the board wholly in the water, making turns difficult to accomplish.

Laterally-spaced, equally-sized triple fins have some advantages over and above paired fins inasmuch that such a board requires somewhat less "rail" to make a turn, but suffers from the fact that the two outer fins tend to over-react to such an extent that fine control may be compromised.

As a modification of the triple fin format, an arrangement involving a large centre-line fin flanked by two smaller, offset fins has been tried out but with limited success. Tandem fins have also been investigated and even five fin arrangements are not unknown. More significantly, recent experimentation has led to multi-fin arrangements in which the outer fins are angled with respect to the longitudinal centre-line of the board so that the leading edges of a laterally-spaced pair of fins are closer together than their trailing edges.

Coupled with the increasing proliferation of multi-fin boards is the trend for boards to be made shorter —as short as 5 feet—and also to be lighter. Such a combination results in tail-heavy boards, unbalanced by the sheer weight to their fin-boxes, if the box system is utilized.

DISCLOSURE OF INVENTION

It has now been found feasible to dispense completely with both fin-boxes and labor-intensive fixed fins, by the provision of a fin affixing system which permits single or multiple fins to be rapidly and inexpensively mounted upon the underside of watercraft, such as a surfboard or the like, in a variety of positions.

Therefore, in accordance with the present invention, there is provided at least one fin for watercraft (e.g., surfboard) or the like;

characterized in that the or each fin has an apertured, basal flange; the or each fin being affixable, in a variety of positions, to the underside of a said surfboard or the like, via fixing means extending through the apertures in said flange, and thence into the fabric of the watercraft, which watercraft requires no fin-box to be installed therein.

The invention also relates to watercraft comprising one or more such fins, generally including, but not limited to, surfboards, surf-skis, sailboards, kayaks, canoes, skiffs and water-skis, and also to "soft" plastic watercraft, such as polyethylene boards e.g., the popular "Boogie" boards.

BRIEF DESCRIPTION OF DRAWINGS

In order that the reader may gain a better understanding of the present invention, certain preferred embodiments thereof will be hereinafter described with reference to the accompanying drawings in which:

FIG. 7 shows a "winged" fin, while

FIG. 8 is a corresponding top plan view;

FIG. 15 shows the underside of an inventive, flanged centreboard or keel;

FIGS. 16 to 23 show outlines of some fin shapes embodying the present invention;

FIGS. 24 and 25 illustrate preferred measurements of the flange apertures (which may vary for different applications), and FIG. 26 illustrates preferred flange dimensions for one embodiment; and FIG. 27 shows a front view of an ideal laterally-disposed left-hand fin.

DETAILED DESCRIPTION OF PREFERRED EMBODIMENTS, and BEST MODES OF CARRYING OUT THE INVENTION FIG. 1 is a side elevation of a fin in accordance with the present invention and shows that portion 1 of a surfboard or the like craft to which an inventive fin 2 is to be affixed. Fin 2 may be of a suitable plastic material; for example, a polycarbonate reinforced with fiber plastic (e.g., as sold under the trade name "LEXAN").

Figure 2:
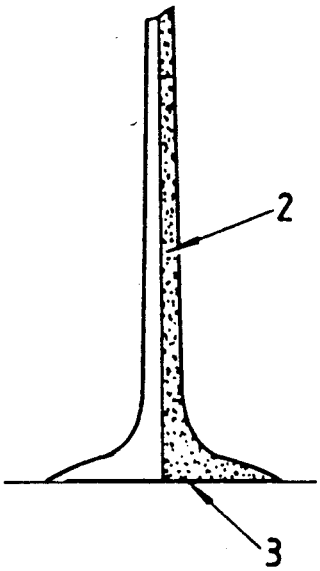
FIG. 2 is a corresponding front view.

It will be seen that fin 2 does not have the conventional root which slots into the fin-box of a standard board, the base 3 of fin 2 being adapted merely to "sit" on the board; base 3 is flared out as shown in FIG. 2.

Figure 14:
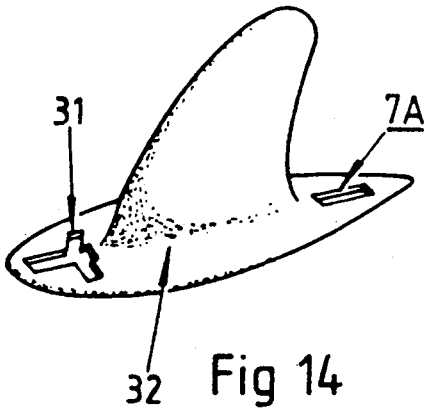
FIG. 14 is a perspective view of an inventive surfboard fin.

The base, or, more aptly, the basal flange 3 has forward and rearward extensions 4 and 5 respectively, each of which is provided with appropriate slotted apertures—see FIGS. 14, 24 and 25—so that the inventive fin 2 is enabled to be adjusted in relation to the undersurface of the board.

Extensions 4 and 5 are affixable to board 1 by such as bolts 6 and 7, each perhaps ½" to 1" long, which are adapted to screw into co-acting, threaded inserts 8 and 9 sunk into the fabric of the board.

Extensions 4 and 5 have tapered ends 10 and 11, so that they are somewhat faired into the board's shape, fore and aft. The bolts and inserts are advantageously made from some rust-resistant material such as monel metal, fiberglass resin itself or a plastic such as Delrin. As will be appreciated, it is quite a simple task to drill two suitable holes into the surfboard and to push home the threaded inserts 8 and 9, preferably after applying a compatible adhesive. Hollow hulls required a suitable sealed thread, with the screws fitted from within, and extending through, the hull, whereby the fin may be attached thereto by hexagonal nuts or other equivalent fastening means. There may be a layer of some compressible material, referenced 12, between board 1 and fin 2, to discourage any chipping of the surface of the board, and to encourage flush fitting. Surf wax may also be another choice.

Figure 1:
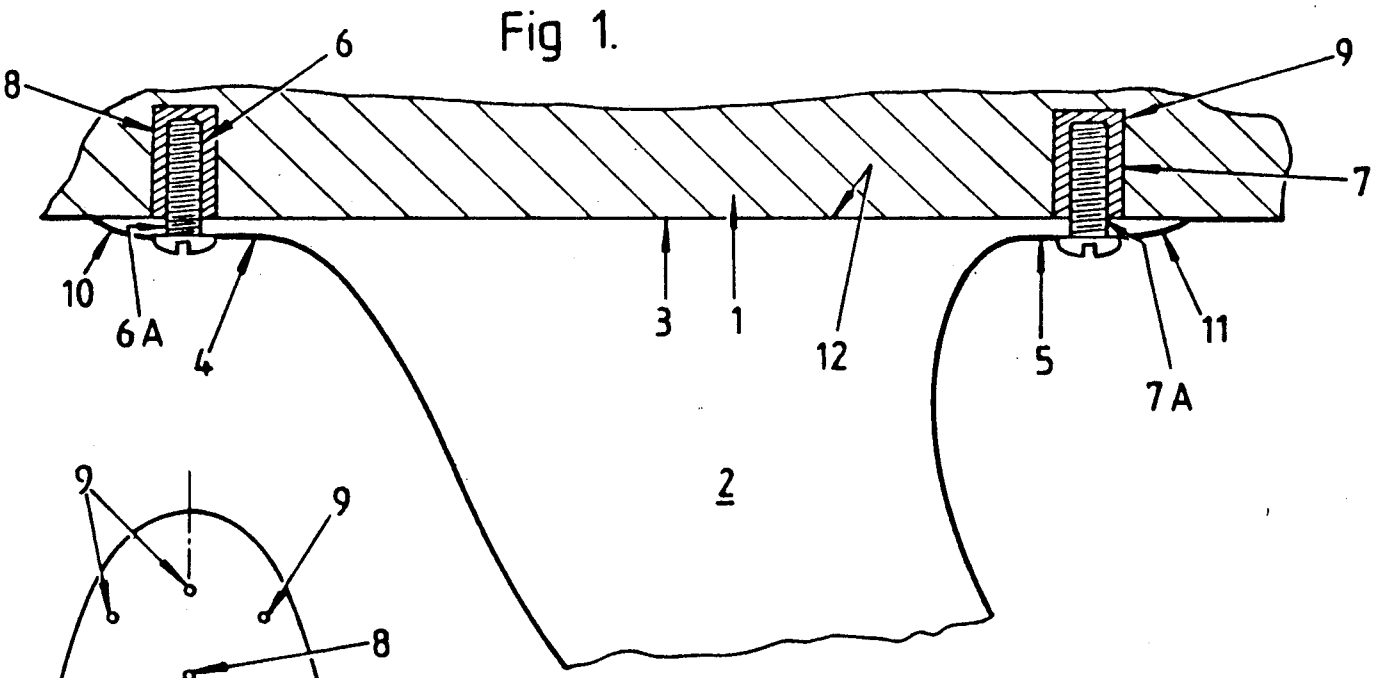
FIG. 1 is a side view of an inventive fin.

FIG. 2 is a self-explanatory front view corresponding to the depiction of fin 2 in FIG. 1. The base of the flange 3 is preferably slightly curved or concave (not shown).

Figure 3:
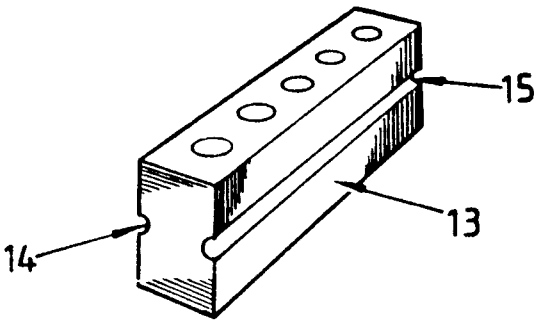
FIG. 3 shows a multi-socketed insert.

FIG. 3 illustrates a preferred embodiment in the form of a multiple-threaded insert block 13 having, say, 5 threaded holes therein, each adapted to take a screw such as those referenced 6 and 7 in FIG. 1. Such a block 13 may be cemented into a suitable cavity in the underside of the surfboard, using a compatible adhesive, and to ensure its retention in the cavity, block 13 may be provided with a pair of grooves 14 and 15.

Figure 4:
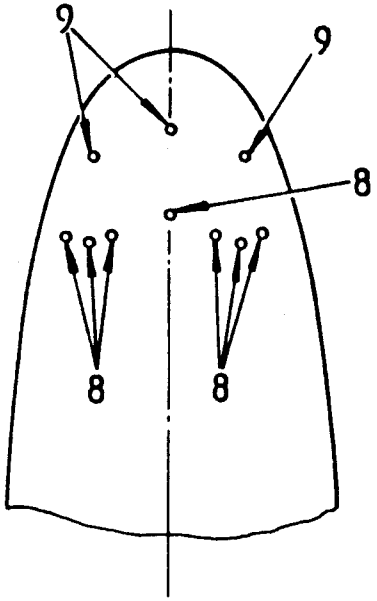
FIGS. 4 to 6 show how a surfboard or other watercraft may variously have multi-socketed, threaded inserts fitted.
Figure 5:
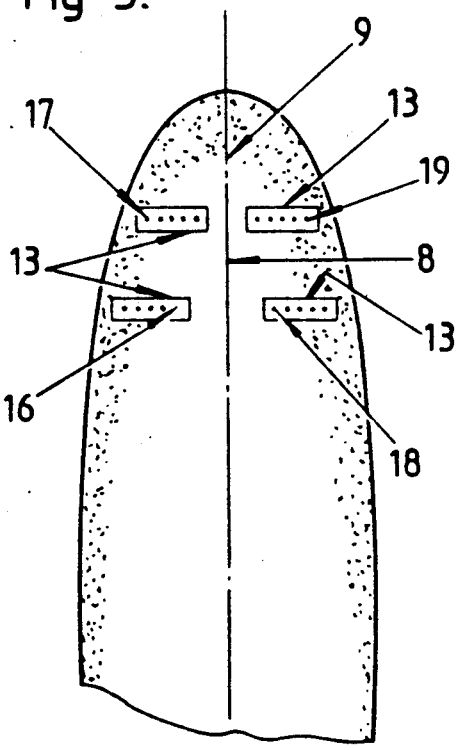
Figure 6:
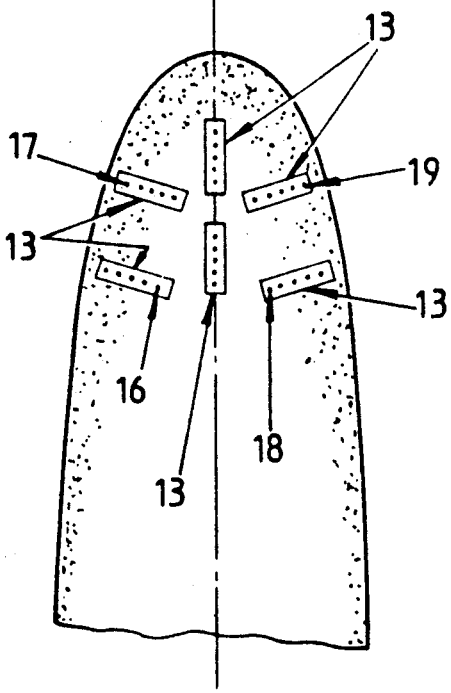

FIG. 4 shows how a board may be fitted with a plurality of threaded inserts 8 and 9 so that the angular disposition of a fin may be selected, while FIGS. 5 and 6 illustrate the range of selectable longitudinal, lateral and angular positions of the fins possible with various arrangements of inserts and/or multiple insert blocks. The slots in extensions 4 and 5 enable, for example, a fin to be affixed to the board via threaded holes 16, 17, and 18, 19, etc.

FIGS. 7 and 8 show another fin shape having a main fin portion 20, an apertured basal flange 21. The trailing edge of the fin has a "compound curve" such as 22, 23 but, more significantly, has a pair of laterally-extending secondary fins 24 and 25, preferably curved, fore and aft (not shown). Under certain wave conditions, these extensions 24, 25 enable easier wave entry and better turns to be performed, and the board feels more stable and responsive if the 'wing' is the correct size, and curve, for the craft.

Figure 9:
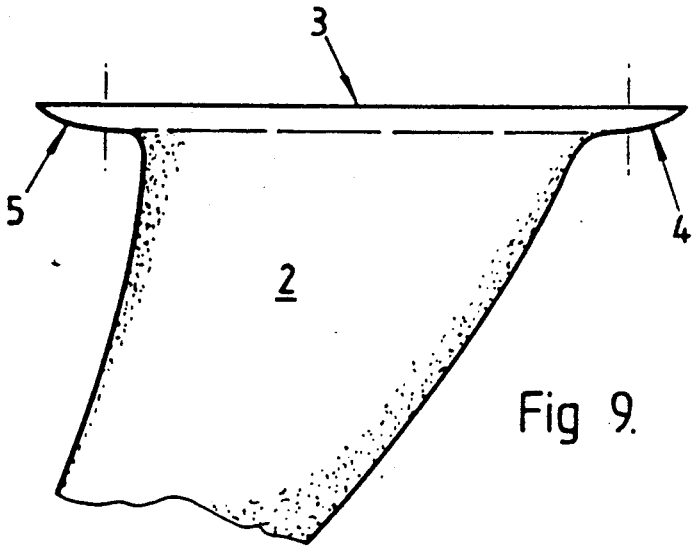
FIG. 9 illustrates a simplified fin.
Figure 10:
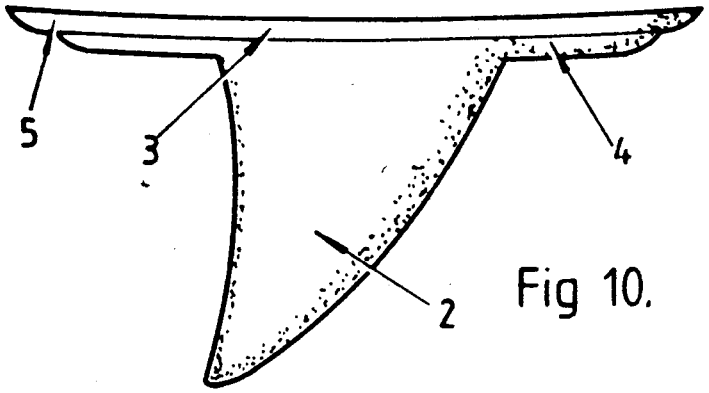
FIG. 10 shows yet a similar fin.

By now the reader will have realized that the very spirit of the present invention resides in dispensing with a surfboard fin-box and labor intensive fixed fin, and providing in lieu thereof a simple and inexpensive fin-securing system, in which a fin is affixed directly to a surfboard, preferably employing bolts or screws accommodated in internally-threaded sunken inserts. FIGS. 9 and 10 illustrate such fins.

Figure 11A:
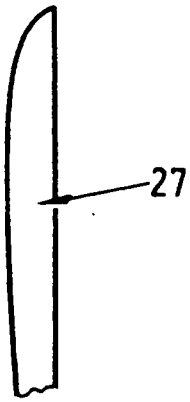
FIG. 11 illustrates how fin cross-sections may differ according to location on a triple-fin board.
Figure 11B:
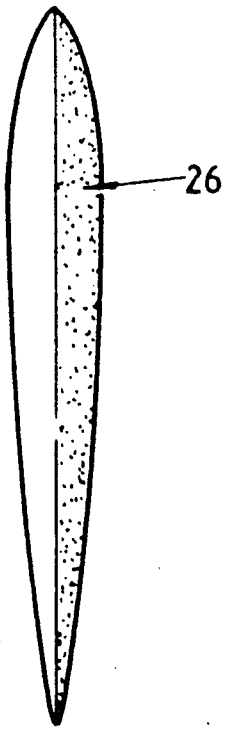
Figure 11C:
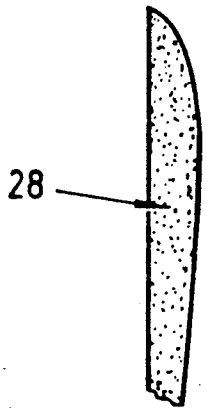

FIG. 11 clearly indicates how fin cross-sections may differ. As will be seen, while the center fin 26 has the conventional aerofoil section, the lateral fins 27 and 28 are generally planar on one side.

Figure 12:
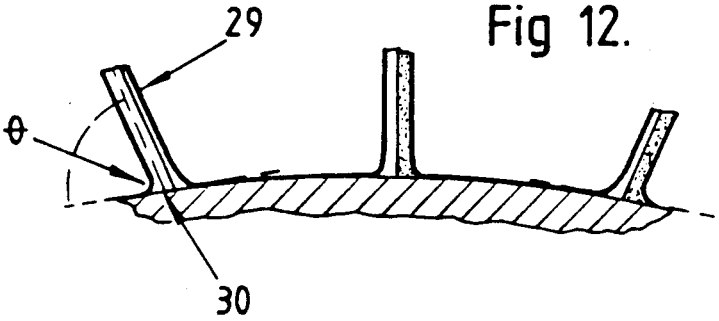
FIG. 12 is a transverse cross-section through a surfboard or the like having a lateral pair of fins canted with respect to the lower surface of the surfboard or other watercraft.

With regard to FIG. 12, it is a known fact that, in triple-finned surfboards, the angle between the lateral fins and the lower surface of the board will affect performance—very extreme angles having, indeed, been tested. Thus, in the present invention, the base lines of the fins may be deliberately angled, as exemplified by the angle subtended between the center-line of a lateral fin 29 and an undersurface 30 of a surfboard.

A further advantage of surfboard fins affixed in position with inserts or blocks over the conventional fin-boxes is that, should for some reason one or more fins be removed, the resulting empty holes can very easily be temporarily filled but, even if they are left empty, cause no drag, whereas an empty fin-box results in quite considerable drag and turbulence. It is contemplated that surfboards molded without fin-box recesses will be supplied with various sets of fittings to the purchaser's choice and that the purchaser will be able to drill the holes in the board to give the fin arrangement required.

Many other advantages accrue from surfboards constructed according to the present invention, such as the question of "tail-lift".

Early surfboards were made with a generally linear bottom contour but with the fore end slightly upswept—the so-called "nose-lift" of the board. This design proved to be not wholly satisfactory and subsequently boards have been made with a full sheer, giving so-called "tail-lift" to the board and providing superior turning qualities and less keel effect.

As will have been appreciated, the spirit of the invention lies in the abolition, or at least in the non-use, of fin-boxes into which the tang of a conventional fin is adapted to fit.

The method of the present invention is superior to both fixed and fin-boxed fins as shown in the following table:

| ITEM | FIXED FIN | FIN BOX | INVENTION |
|---|---|---|---|
| Performance | good | medium | good |
| Strength | good | high-overkill | good |
| Surfboard damage if broken | medium-bad | very bad | minimal |
| Ease of fitting | experience only | experience only | easy |
| Flexability of position | none | fore-aft only | unlimited |
| Materials | G.R.P., wood foam, others | G.R.P. poly-carb, others | polycarb others |

-continued

| ITEM | FIXED FIN | FIN BOX | INVENTION |
|---|---|---|---|
| Base fitting correction | not possible | possible fore - aft | possible (unlimited) |
| Before-use fitting time | 6 to 12 hours | 6 to 12 hours | 30 mins. minimum |
| Appearance | good | ugly | good |
| Material requirements to fit | resin; brush; rovings; glass mat; sander machine sandpaper; blade; tape | resin; rovings; jig; router; sander machine | drill or router; epoxy glue (G.R.P. choice) sandpaper; blade |
| Advantages | invisible join | removable - interchange fins | removable; ease of positioning (change of angles) inbuilt angle; do-it-yourself; quick-fitting lightweight; interchangeable fins; inexpensive tooling; also fits fin boxes |
| 'BOOGIE' fin fitting | not possible | only in production process | fits "soft" boards (e.g., polyethylene). |

Attention must now be drawn to some further preferred variations and to this end reference should be made to the following drawings, FIGS. 13 to 27.

Now while the aim of the invention is to do away with fin boxes and fixed fins, it is realized that some board-riders may wish to fit new fins to their existing fin-boxed boards and this can, or course, be easily accomplished by screwing the fin into the fabric of the fin box instead of into the board itself. Because of different brand boxes and their complimentary fin tangs being of different widths in the box, this system is unique in being universal. In a further variation, not shown, expanding or "umbrella" screws may be employed, sealed in with rubber or neoprene O-rings. In yet a further variation, rustless self-tapping screws may replace the screw/insert arrangement, to allow screw fixing directly into the craft itself.

Figure 13:
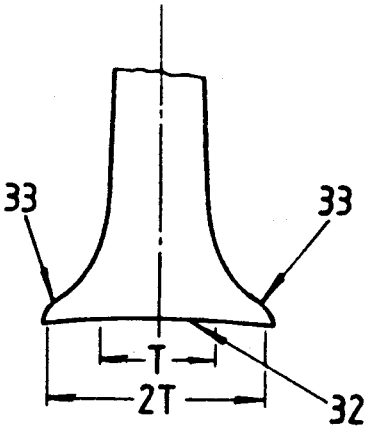
FIG. 13 shows, in fragmentary transverse vertical cross-section, a modification.

FIGS. 13 and 14 depict an inventive fin, FIG. 14 having a T-shaped slot 31 forward of the leading edge of the fin. As seen in FIG. 13, the base 32 of the fin should be well-flared at the sides 33.

These flares should provide sufficient width at the base of the fin to oppose lateral deflection of the fin tip relative to the base without causing damage to the skin of the board. The varying thickness gives a more uniform spread of load at the fin/board interface—the need to reinforce the board in the area of the fin by providing an extra layer of glass being much reduced. The width of the fin at T is advantageously half that of the base 2T, and base 32 may be cambered 3° each side, although this will vary according to fin area and flex.

Although the method of fin-fitting relies on screws there is no reason why, if desired or when optimum positioning has been achieved, they should not be bonded to the board by such as the epoxy adhesive sold as "Araldite", although it is contemplated that most users would prefer the removable aspect of the system of the present invention.

A fin may be "raked" by such as a washer or shim placed between fin and board, while a fin may even be made to "stand proud" of its board—an arrangement thought to have some advantages under certain conditions.

While the foregoing specification has been couched in terms of surfboards, it is envisaged that the present invention also has application to the fins, keels and centreboards of other watercraft such as soft 'BOOGIE' boards sailboats (such as eighteen-footers), sailboards, catamarans, surfskis, kayaks, canoes and the like. FIG. 15 shows the underside of a suitable flanged centreboard or keel having slots 34 for the reception of fixing bolts.

FIGS. 16 to 21, and 22, 23 show outlines of eight different fin shapes as under: 35 "sailfin"; 36 "trapezoidal"; 37 "football"; 38 "toucam"; 39 "foot"; 40 "flash"; 41 "sailboard"; 42 "surfski"; all of which relate to the present invention.

FIGS. 24 and 25 show typical dimensions of the basal flange slots of one embodiment of the invention, dimension A being 5.5 mm; B being 15 mm; and C 9.5 mm. In FIG. 26, dimension D, the thickness of the basal flange, is 4 mm.

Finally, FIG. 27 depicts an inventive left-hand fin, showing that side 43 is curved, while side 44 is planar. The width of a typical basal flange may be 35 mm, and the planar sides 44 of laterally-disposed fins face towards the centreline of the board. As has been stated, the base of the flanges may be slightly concave to follow the contour of a board's lower surface.

From the abovegoing, it will be readily appreciated by those skilled in the art that may other variations and modifications may be made to the invention without departing from the spirit and scope thereof as set out in the following claims.

I claim:

1. A fin for finned waterborne craft said fin having a basal flange able to be removably attached to the underside of said waterborne craft via fixing means, said basal flange having forward and rearward extensions each having therethrough an aperture in the form of a slot adapted to receive a said fixing means, thereby permitting fore-and-aft adjustment of said fin in relation to the underside of the waterbone craft without the necessity for detaching the fin and its basal flange therefrom;

characterized in that:

said forward slot is T-shaped, thereby additionally permitting lateral adjustment of the forward end extension of said basal flange in relation to the underside of the said waterborne craft.

2. The fin as claimed in claim 1, wherein said fixing means are bolts adapted to screw into co-acting, internally-threaded inserts accommodated in the underside of the waterborne craft.

3. The fin as claimed in claim 1, wherein said fixing means are bolts each adapted to screw into a co-acting, internally-threaded bore in the multiple-bore insert block accommodated in the underside of the waterborne craft.

4. The fin as claimed in claim 1, or claim 2, wherein the said fin includes a main portion on which is an opposed pair of laterally-extending secondary fins disposed in a plane normal to that of said main portion in a fore-and-aft direction.

* * * * *